US005682719A

United States Patent [19]

Huang

[11] Patent Number: 5,682,719

[45] Date of Patent: Nov. 4, 1997

[54] SCREEN COMBINATION

[76] Inventor: Chin-Fa Huang, No. 526, Chung Shang Road Section 2, Hua Tan Hsiang, Chang Hua Hsien, Taiwan

[21] Appl. No.: 679,824

[22] Filed: Jul. 15, 1996

[51] Int. Cl.[6] ..... A47G 5/00; A47G 29/02

[52] U.S. Cl. ..... 52/775; 52/780; 52/764; 52/586.2; 52/586.1; 52/239

[58] Field of Search ..... 52/586.1, 238.1, 52/239, 586.2, 731.2, 731.3, 731.5, 730.5, 775, 730.3, 730.4, 734.1, 780, 781, 764

[56] References Cited

U.S. PATENT DOCUMENTS

| | | | |
|---|---|---|---|
| 3,370,389 | 2/1968 | MacAlwso | 52/775 X |
| 3,486,287 | 12/1969 | Guillon | 52/239 X |
| 3,490,800 | 1/1970 | Wissler | 52/586.1 X |
| 3,513,606 | 5/1970 | Jones | 52/239 X |
| 4,021,973 | 5/1977 | Hegg et al. | 52/781 X |
| 4,026,084 | 5/1977 | Goose | 52/780 |

*Primary Examiner*—Robert Canfield
*Attorney, Agent, or Firm*—Charles E. Baxley, Esq.

[57] ABSTRACT

A screen combination includes two side beams and an upper beam and a lower beam for securing a panel. The upper and the side beams each includes three flat surfaces intersected with each other. A mortise is formed in each of the flat surfaces. The upper and the side beams each includes two side portions each having a channel for engaging with screws so as to attach accessories to the beams. The upper and the side beams each includes a groove for engaging with the panel. A number of angles are secured to the beams so as to couple the beams together. A number of tenons are engaged with the mortises so as to couple the beams together.

2 Claims, 16 Drawing Sheets

SCREEN COMBINATION

BACKGROUND OF THE INVENTION

1. Field of the Invention

The present invention relates to a screen combination, and more particularly to a screen combination having a number of panels that may be assembled according to the users need.

2. Description of the Prior Art

A typical screen or panel for partitioning a room is disclosed in UK patent application No. 8521011, and published with publication number GB 2180276. However, the panels may not be assembled according to the users need.

The present invention has arisen to mitigate and/or obviate the afore-described disadvantages of the conventional screens.

SUMMARY OF THE INVENTION

The primary objective of the present invention is to provide a screen combination including a number of panels that may be easily assembled and that may be easily disassembled and that may be assembled according to the users need.

In accordance with one aspect of the invention, there is provided a screen combination comprising at least one panel, at least one frame including two side beams and an upper beam and a lower beam for engaging the panel therein, the upper and the side beams each including three flat surfaces intersected with each other, the flat surfaces each including a mortise formed therein, the upper and the side beams each including two side portions each having a channel formed therein, the upper and the side beams each including a groove formed therein for engaging with the panel, a plurality of angles each including two plates secured to the upper and the lower beams and the side beams so as to couple the beams together, and a plurality of tenons engaged with the mortises so as to couple the beams together.

The frame includes two caps secured on the side beams and the upper beam for covering the mortises.

A plurality of screws each includes a head slidably engaging with the channels so as to attach accessories to the beams.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
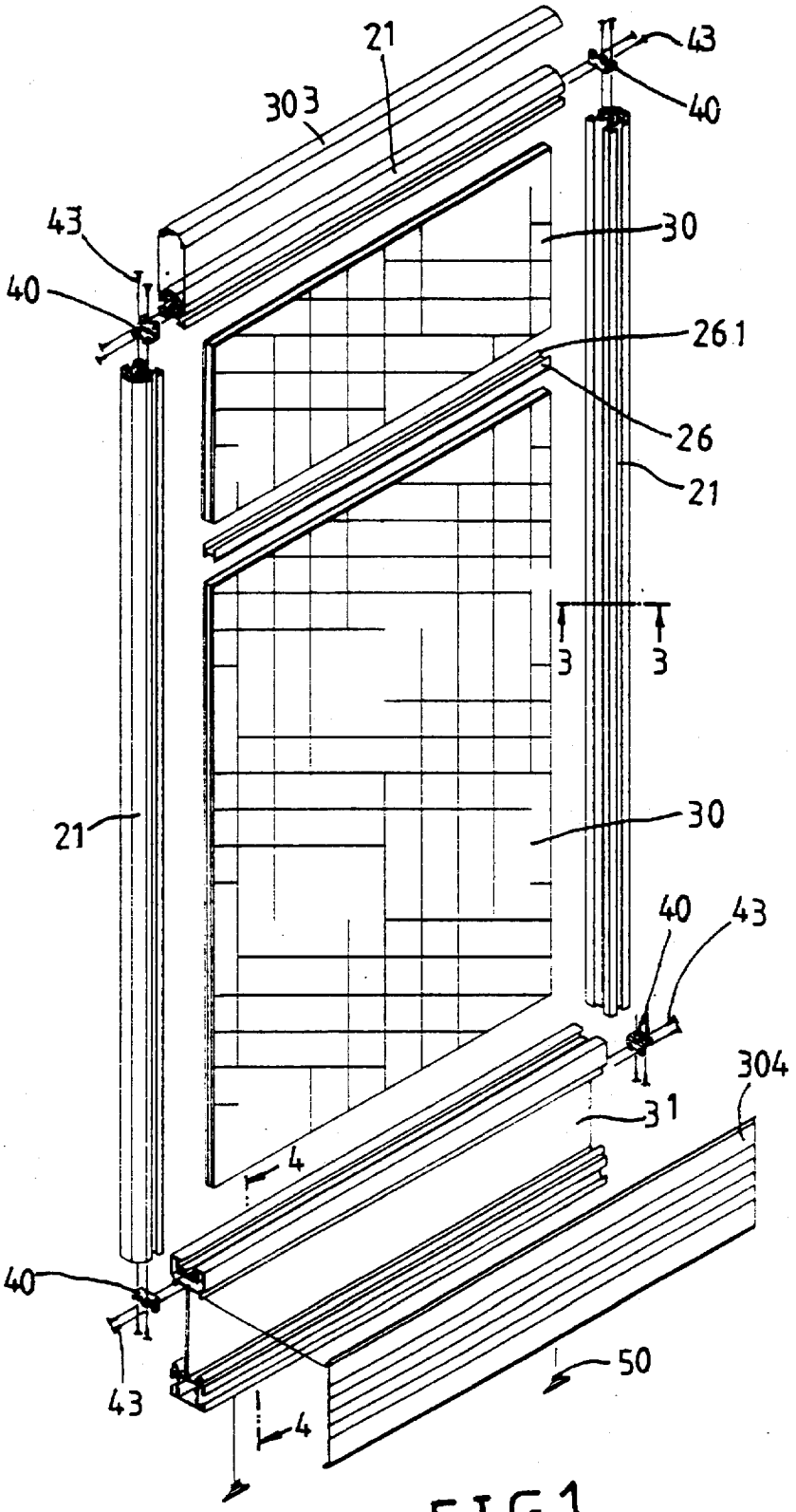
FIG. 1 is an exploded view of a screen combination in accordance with the present invention.
Figure 2:
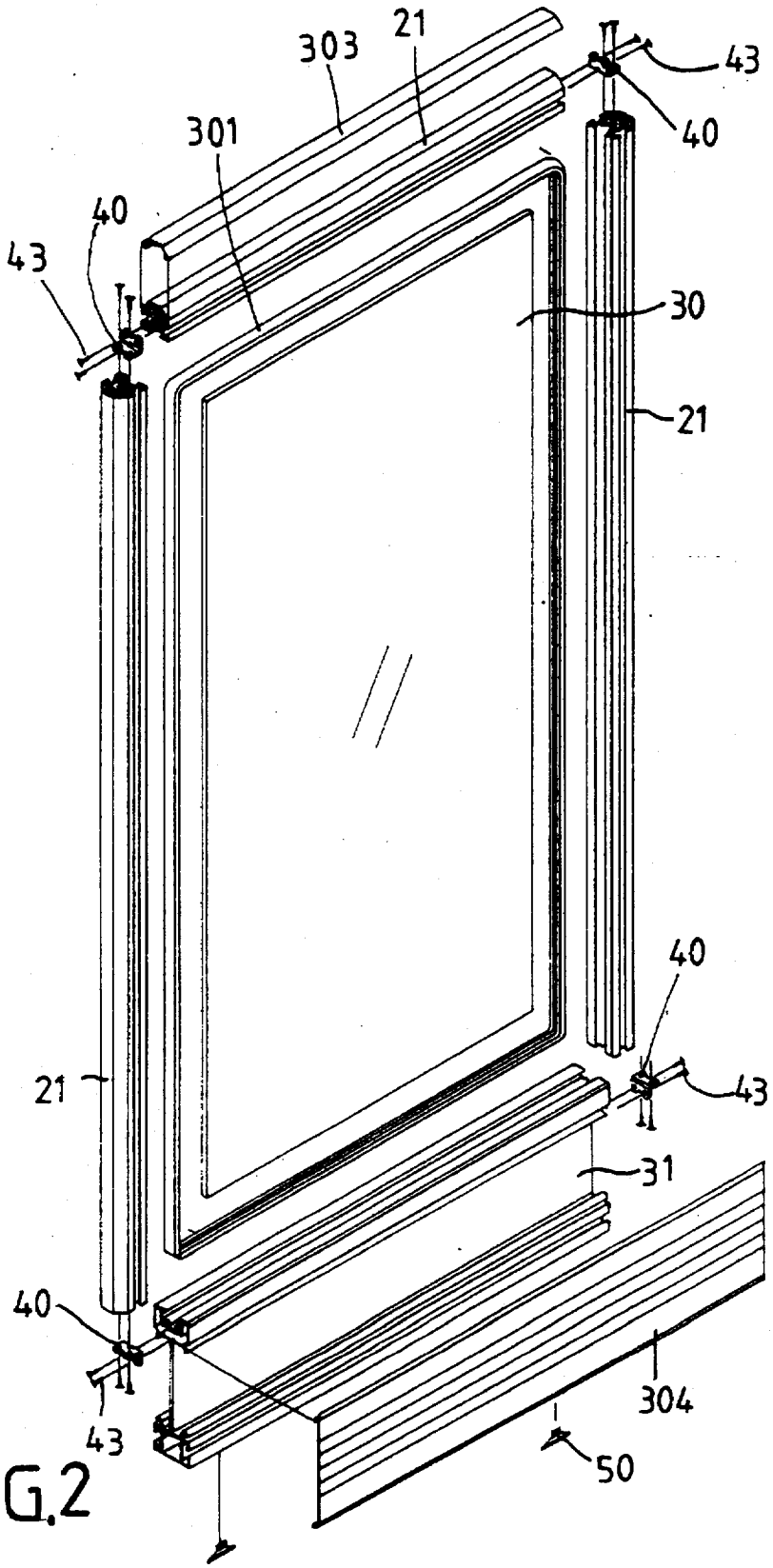
FIG. 2 is an exploded view showing another application of the screen combination.

Referring to the drawings, and initially to FIGS. 1 to 4, a screen combination in accordance with the present invention comprises a number of frames each including two side beams 21 and one upper beam 21 and a lower beam 31 forming the sides and the upper portion and the lower portion thereof for engaging one or more panels 30 therein. Alternatively, as shown in FIG. 2, a peripheral pad 301 is provided between the beams 21 and the panel 30 of glass material for protecting the panel 30 from being broken. The screen combination includes one or more bars 26 laterally engaged between the side beams 21 for securing one or more panels 30 in the frames 20. The bars 26 each includes two slots 261 formed in the upper and lower portions thereof for engaging with the panels 30.

Figure 3:
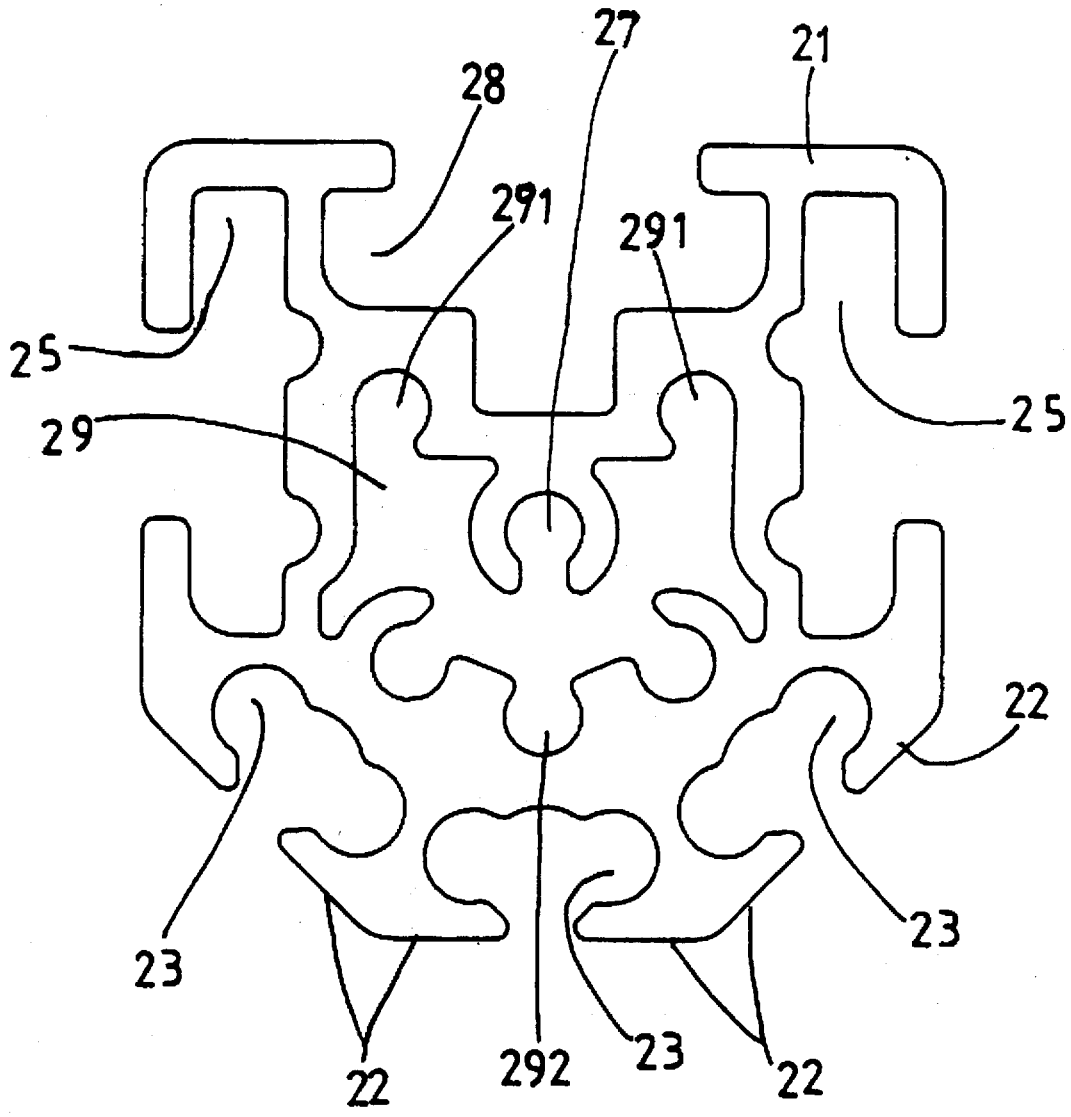
FIG. 3 is a cross sectional view taken along lines 3—3 of FIG. 1.
Figure 4:
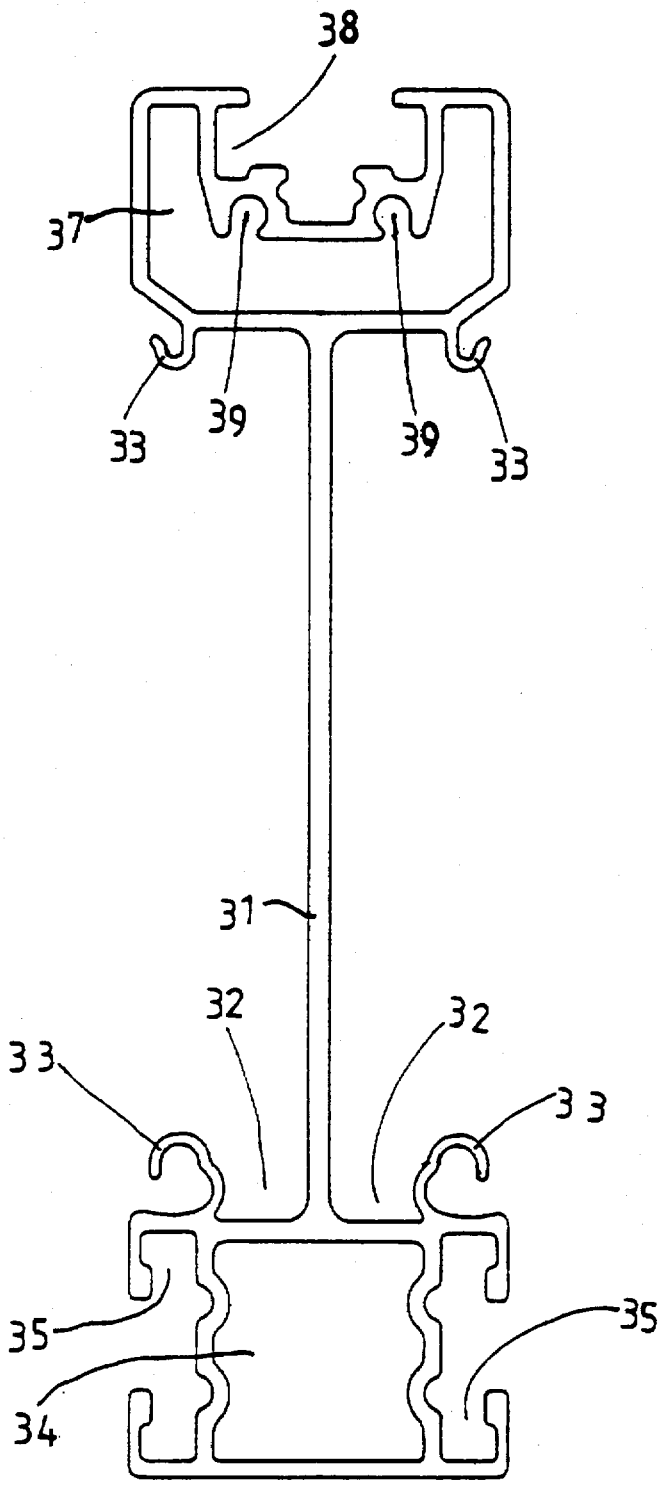
FIG. 4 is a cross sectional view taken along lines 4—4 of FIG. 1.

As shown in FIG. 3, the side beams and the upper beam 21 each includes three flat surfaces 22 the adjacent flat surfaces having an included angle of about 135 degrees therebetween and each having a mortise 23 formed therein for engaging with tenons 10, 101 (FIGS. 7–10) so as to couple and secure the beams 21 together. The upper and the side beams 21 each includes two C-shaped channels 25 for engaging with the head 511 of the screw 51 (FIG. 6) and for securing accessories to the beams 21. The upper and the side beams 21 each includes a C-shaped groove 28 formed therein for engaging with the edge portions of the panels 30 and the end portions of the bars 26, and each includes a hole 29 for reducing the weight thereof. The upper and the side beams 21 each includes one or more screw holes 27, 291, 292 for engaging with screws 43. The lower beam 31 includes two depressions 32 defined by two lower hooks 33 for engaging with electric wires and includes two upper hooks 33 for engaging with decorative panel 304 (FIG. 1) therein together with the lower hooks 33. The lower beam 31 includes two conduits 35 for receiving accessories therein and includes a hollow chamber 34 formed therein and includes screw holes for securing foot members 50 (FIGS. 1 and 2) thereto. The lower beam 31 further includes a hollow space 37 formed in the upper portion and includes a channel 38 formed in top thereof. Two screw holes 39 are provided for engaging with fastening screws.

As shown in FIGS. 7–10, a number of angles 40 each includes two plates 41, 42 (FIG. 7) secured to the end portions of the beams 21. The plates 41, 42 each includes two holes 411, 421 formed therein for engaging with screws 43 which are engaged with the screw holes 291 and 39 so as to secure the angles 40 to the beams 21, 31. A number of caps are secured to the angles 40 for covering the screws 43. As shown in FIGS. 1, 2, 8, 9, a number of covers 303 are engaged onto the outer portion of the beams 21 for covering the beams 21.

Figure 5:
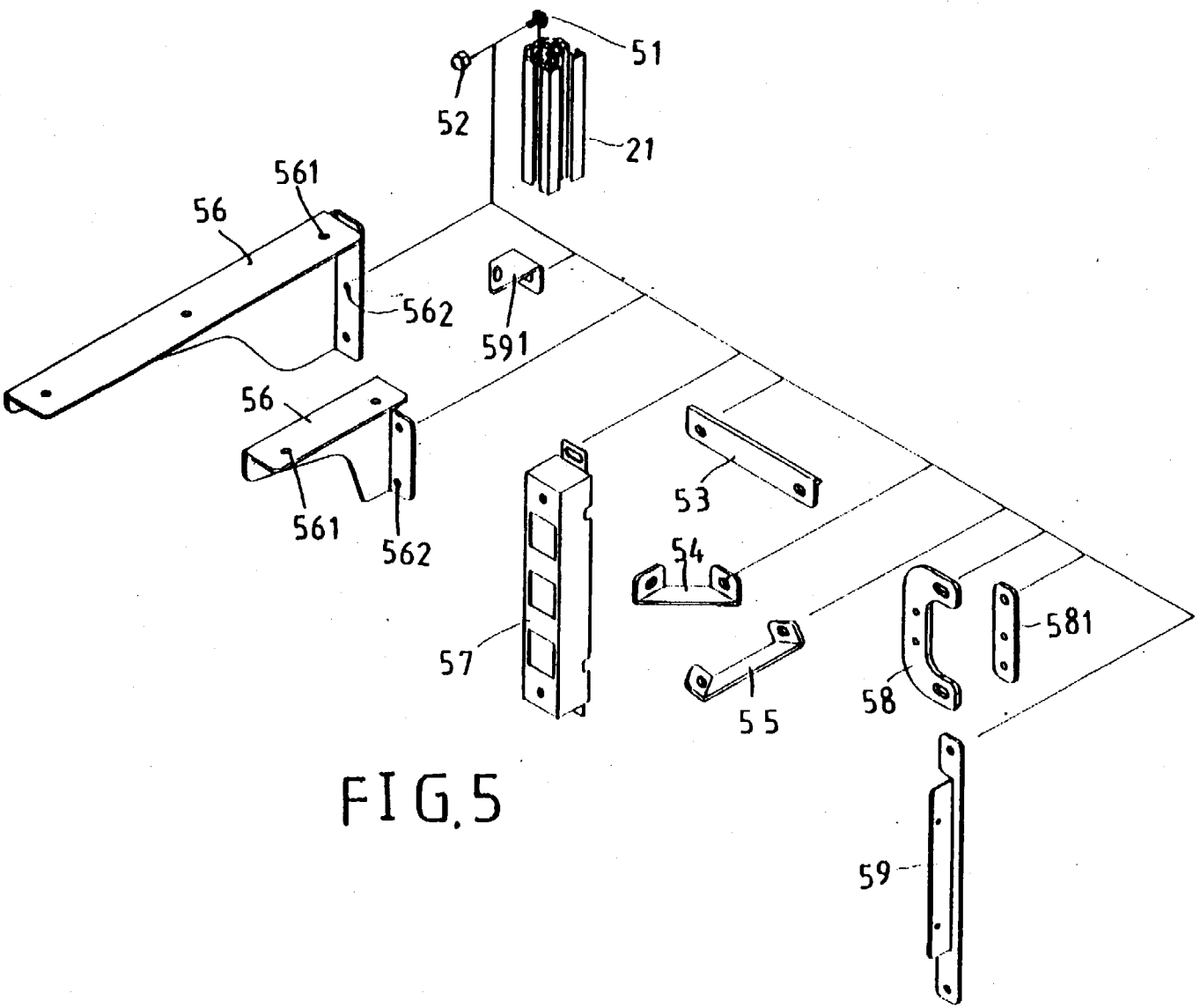
FIG. 5 is an exploded view illustrating the accessories of the screen combination.
Figure 6:
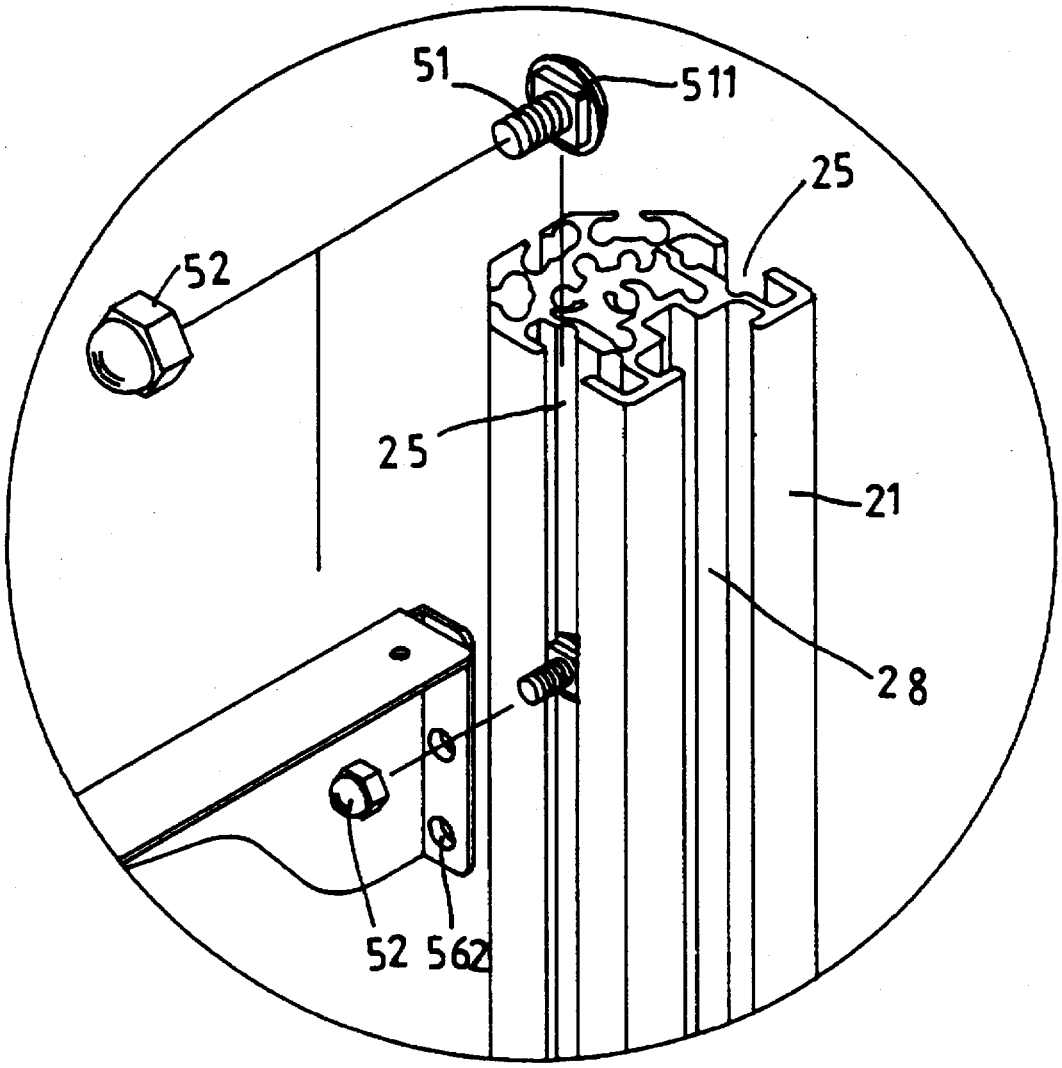
FIG. 6 is a partial perspective view illustrating the accessories of the screen combination.
Figure 7:
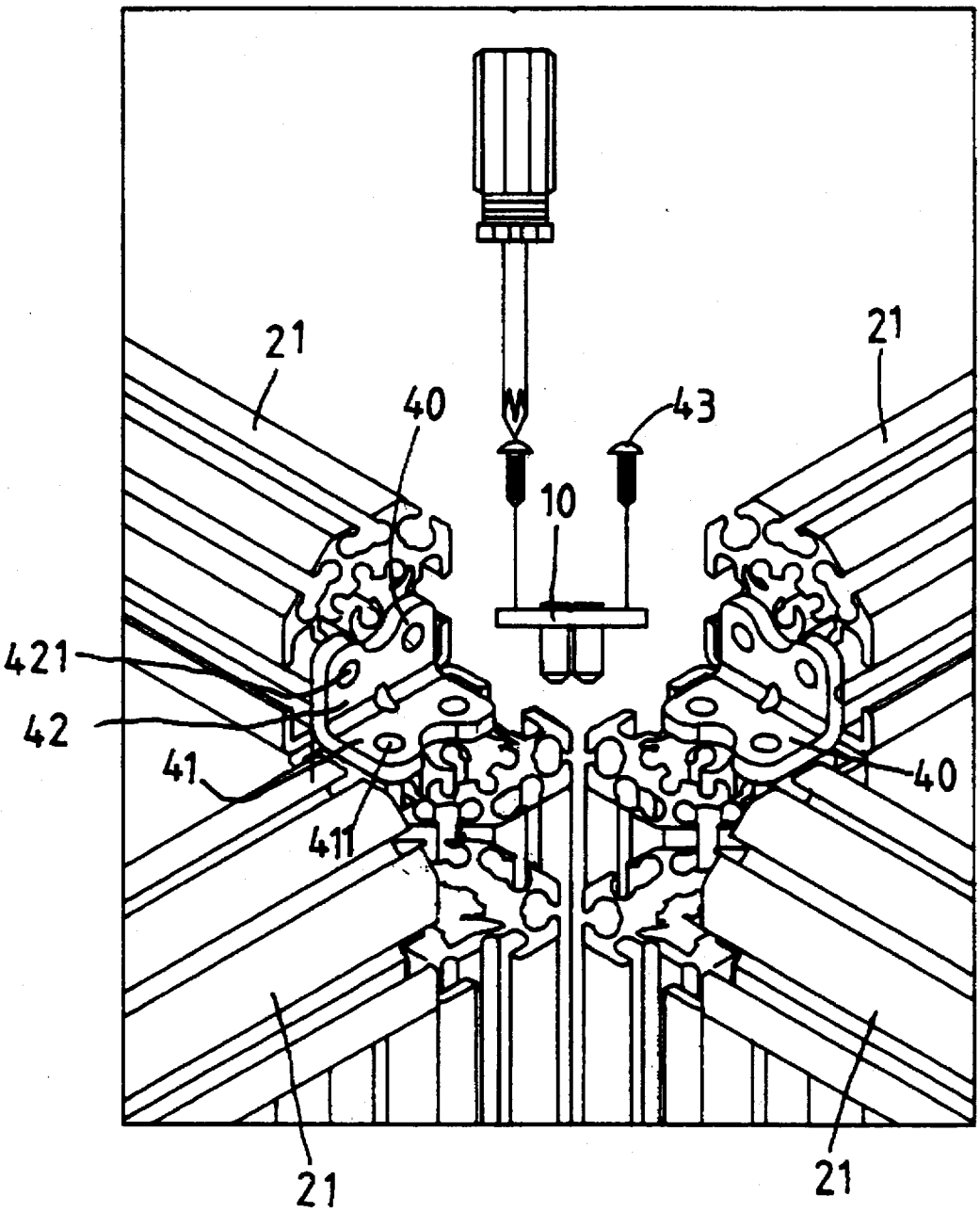
FIGS. 7, 8, 9 and 10 are partial perspective views illustrating the coupling portions of the screen combination.
Figure 8:
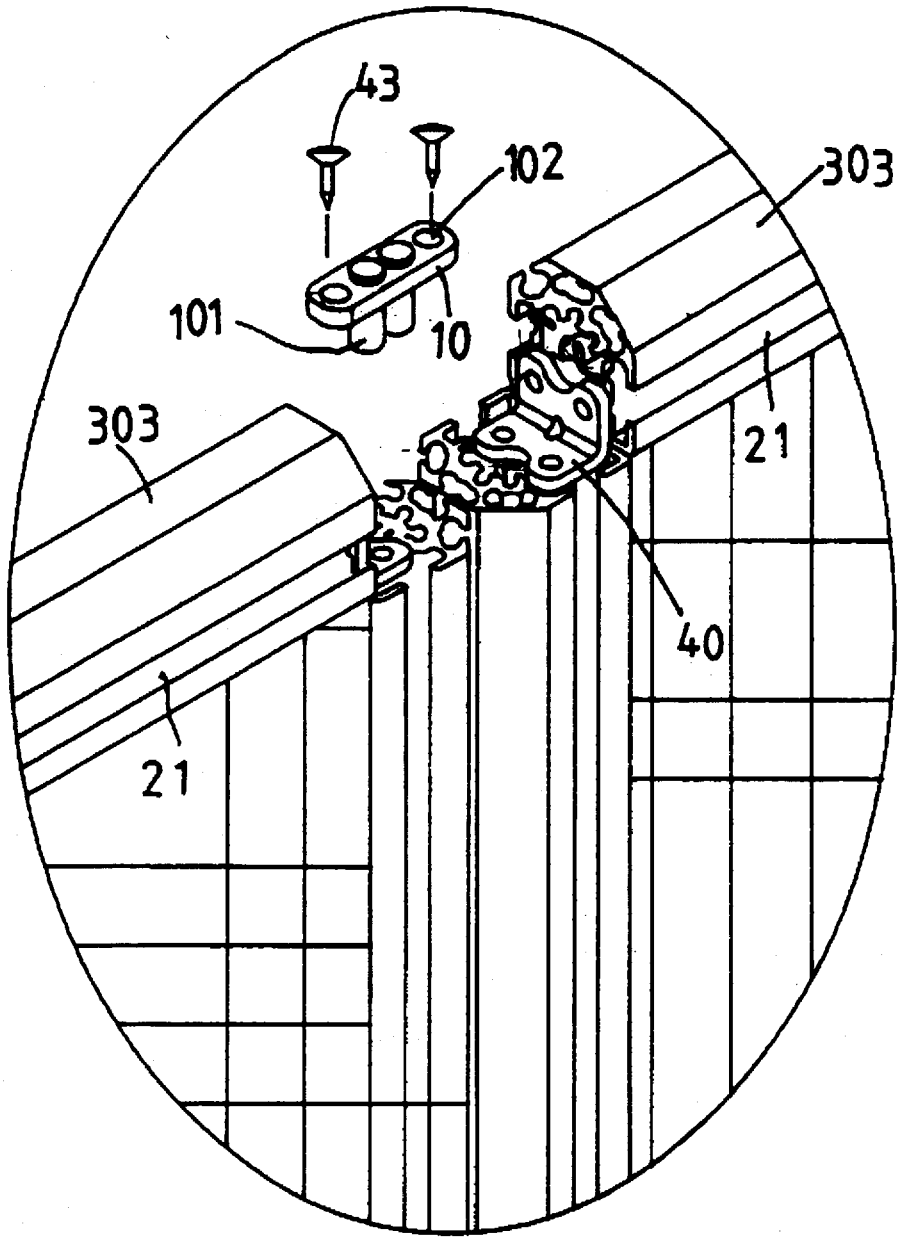
Figure 9:
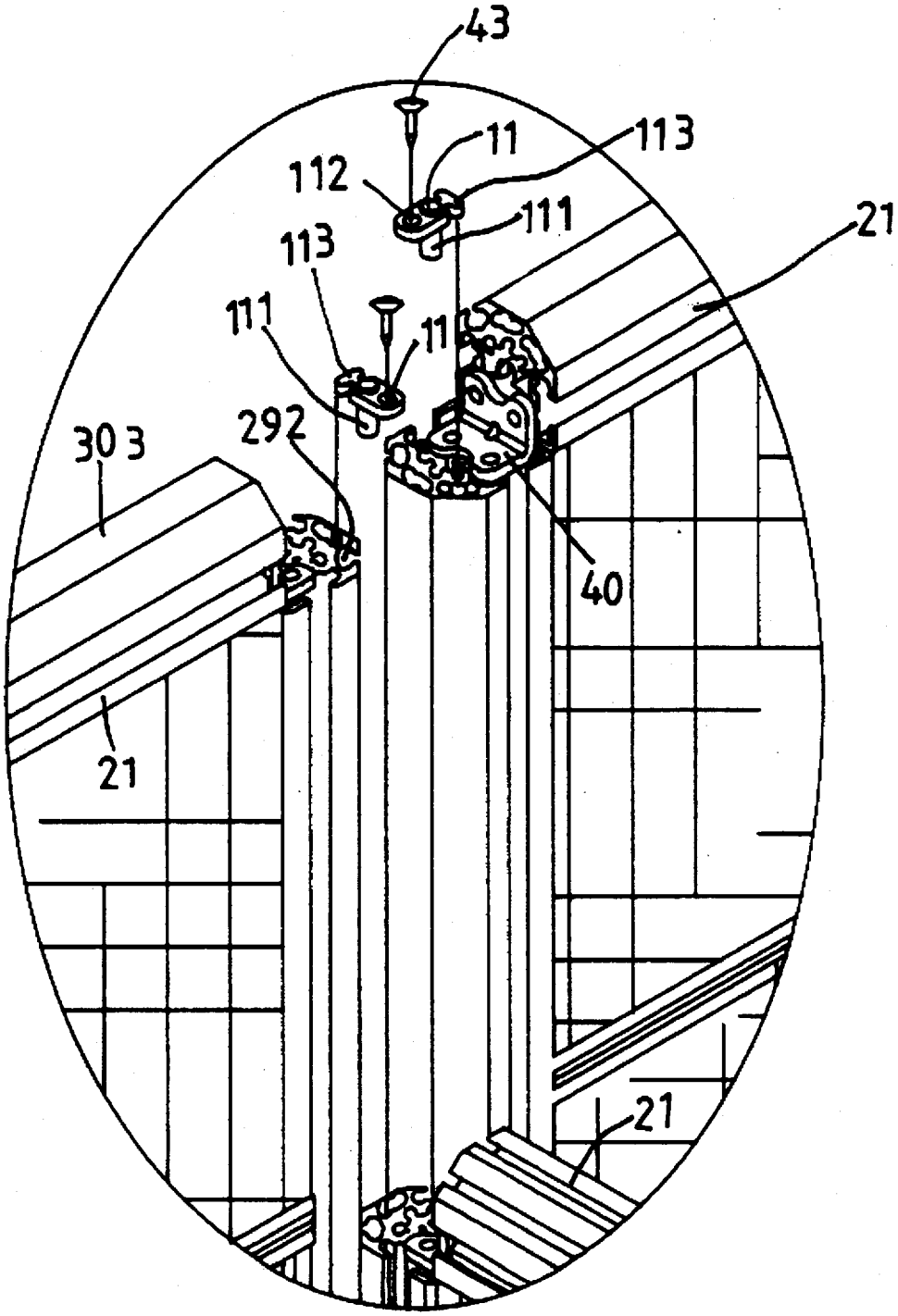
Figure 10:
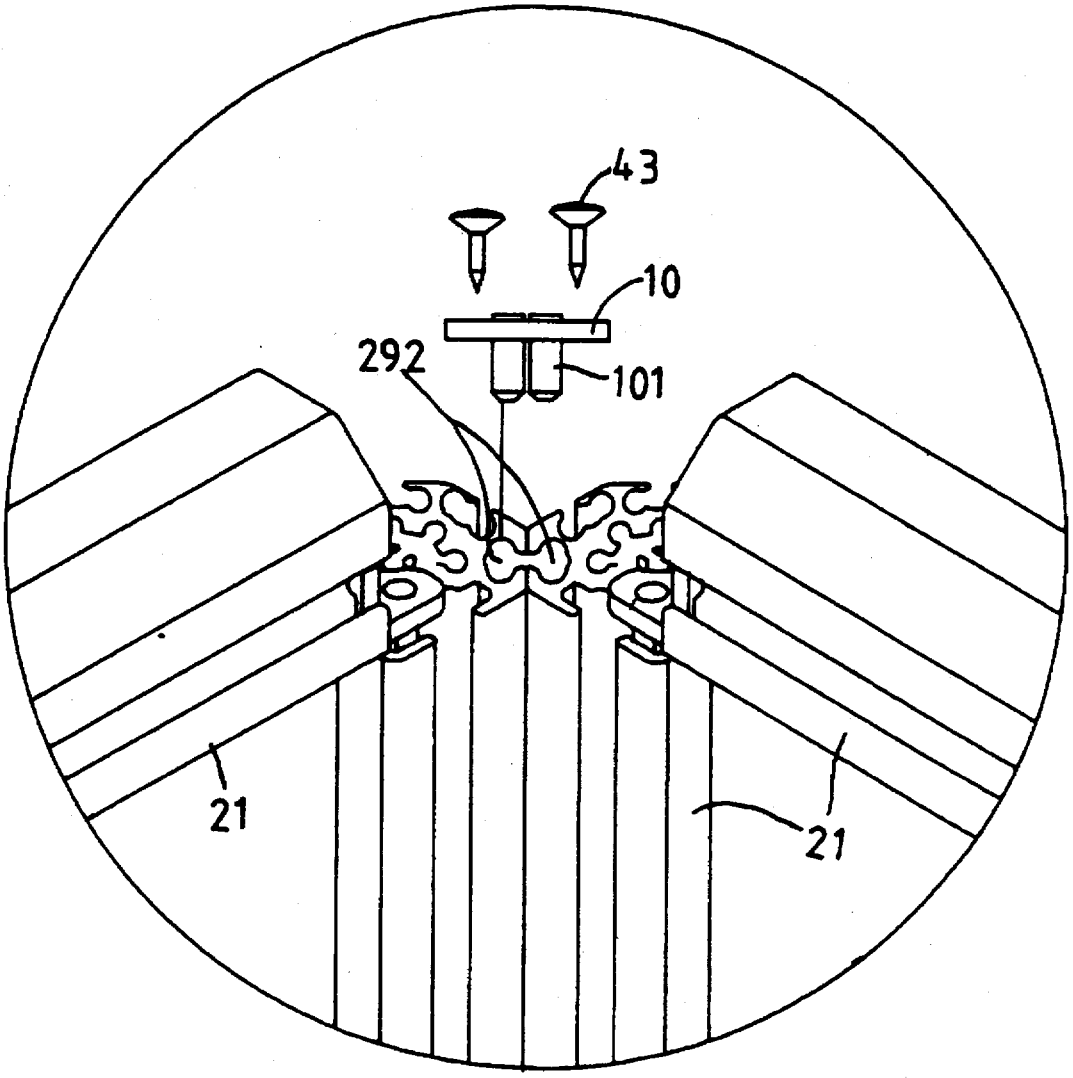
Figure 11:
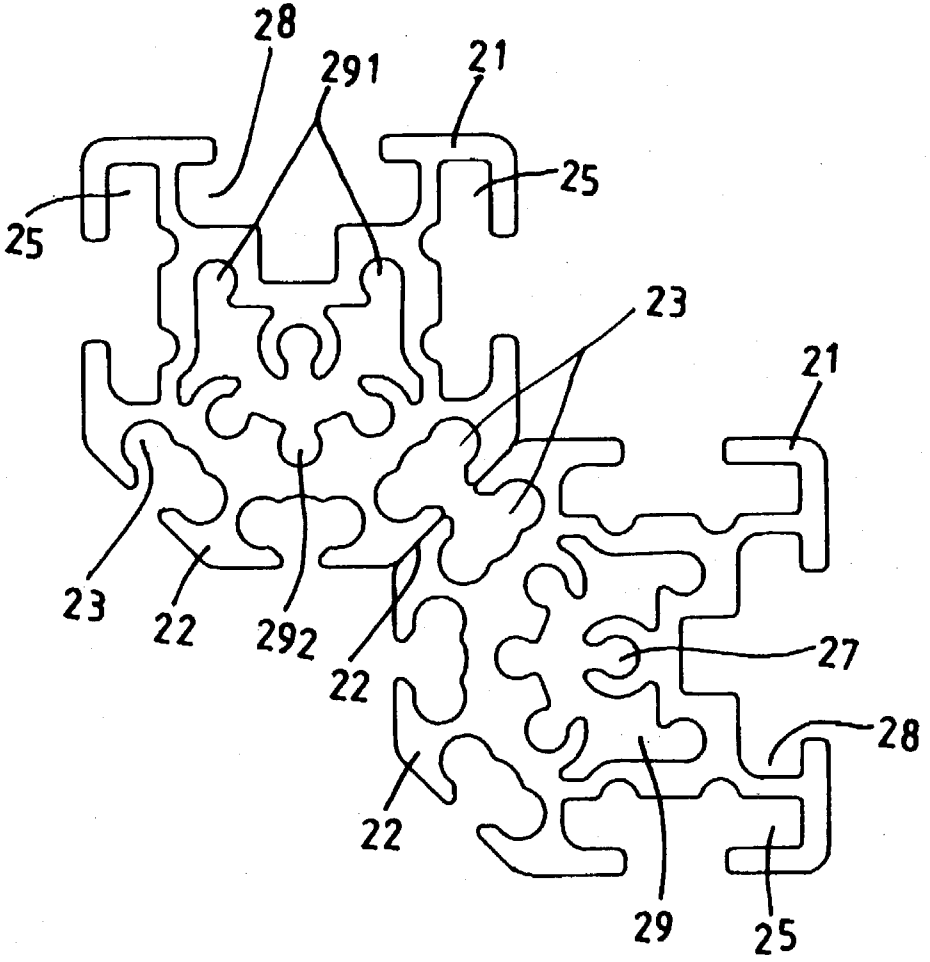
FIGS. 11, 12, 13, 14, 15 and 16 are schematic views illustrating the coupling of the beams.
Figure 12:
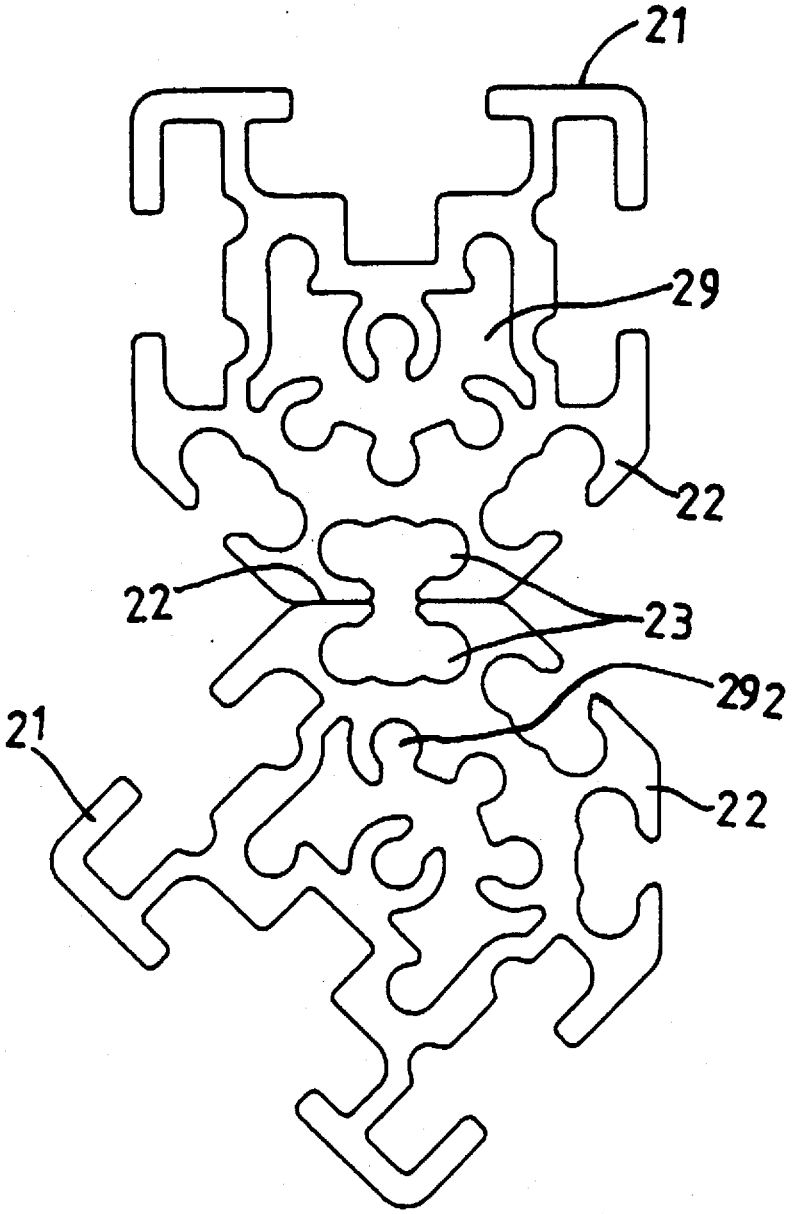
Figure 13:
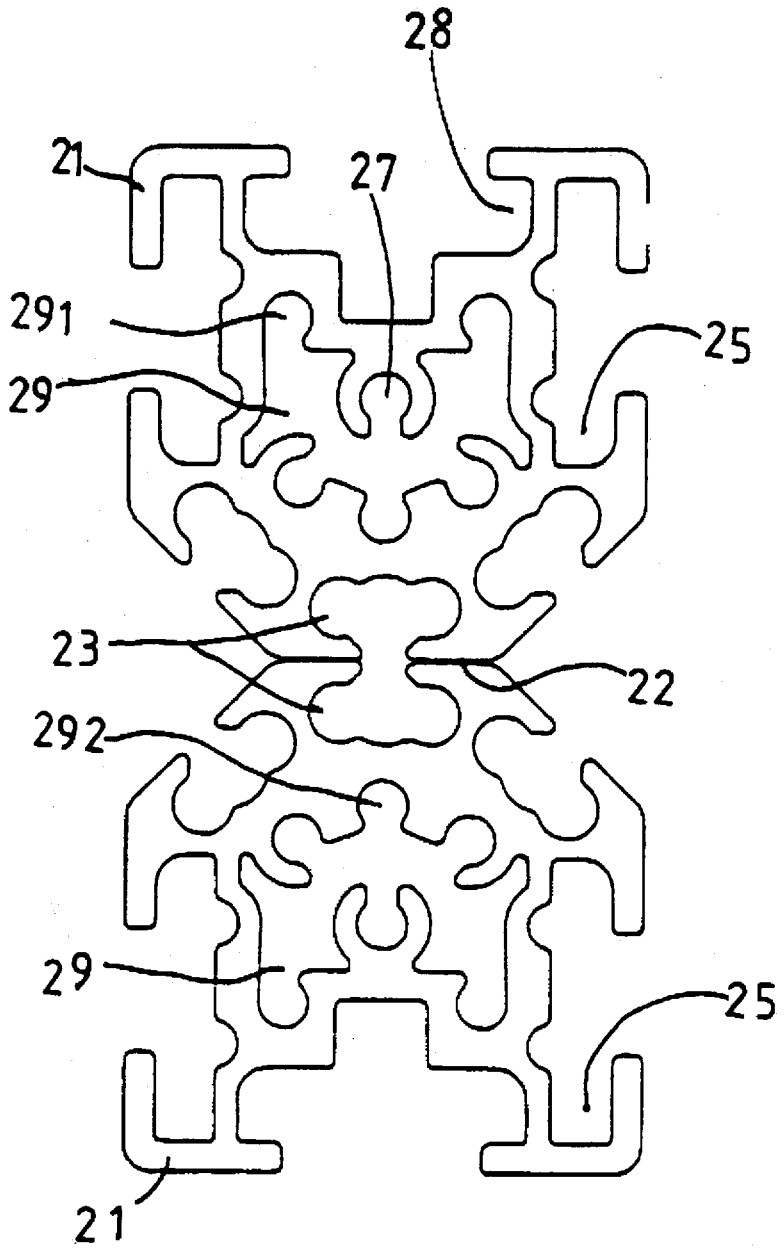
Figure 14:
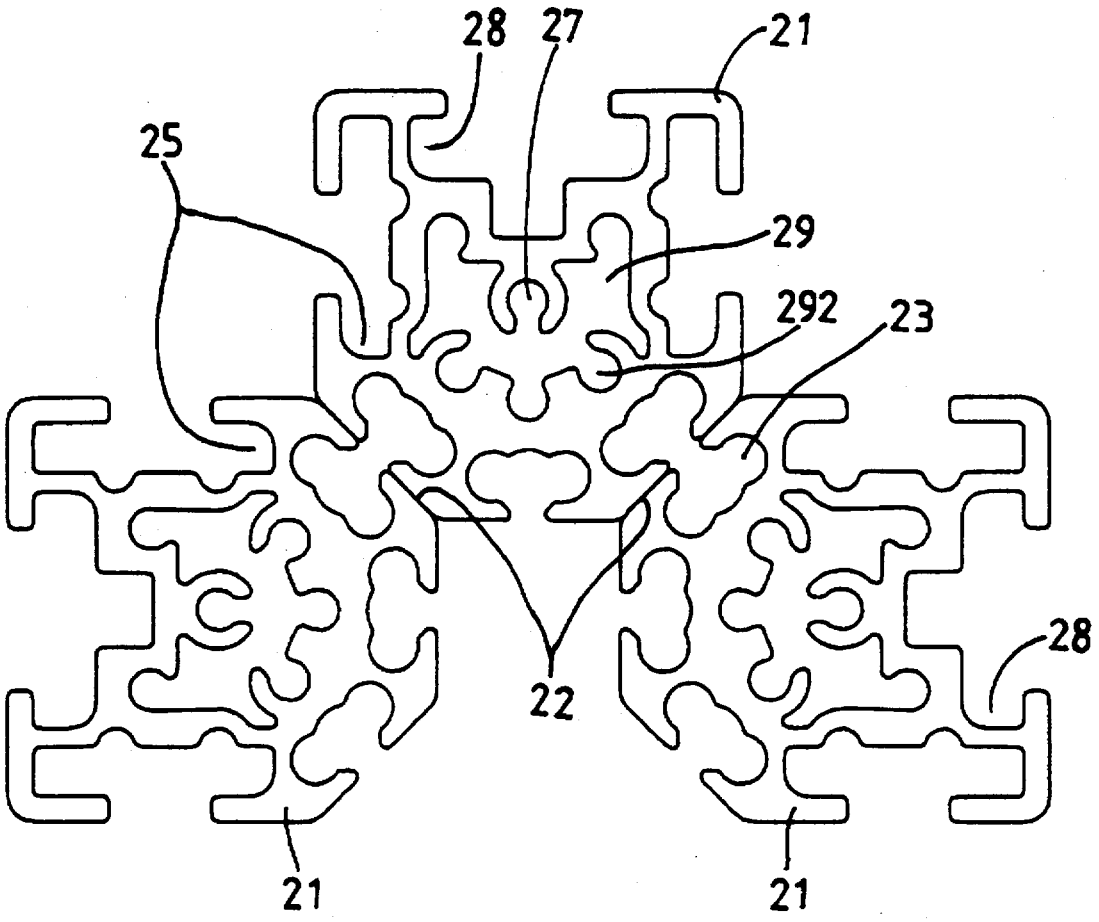
Figure 15:
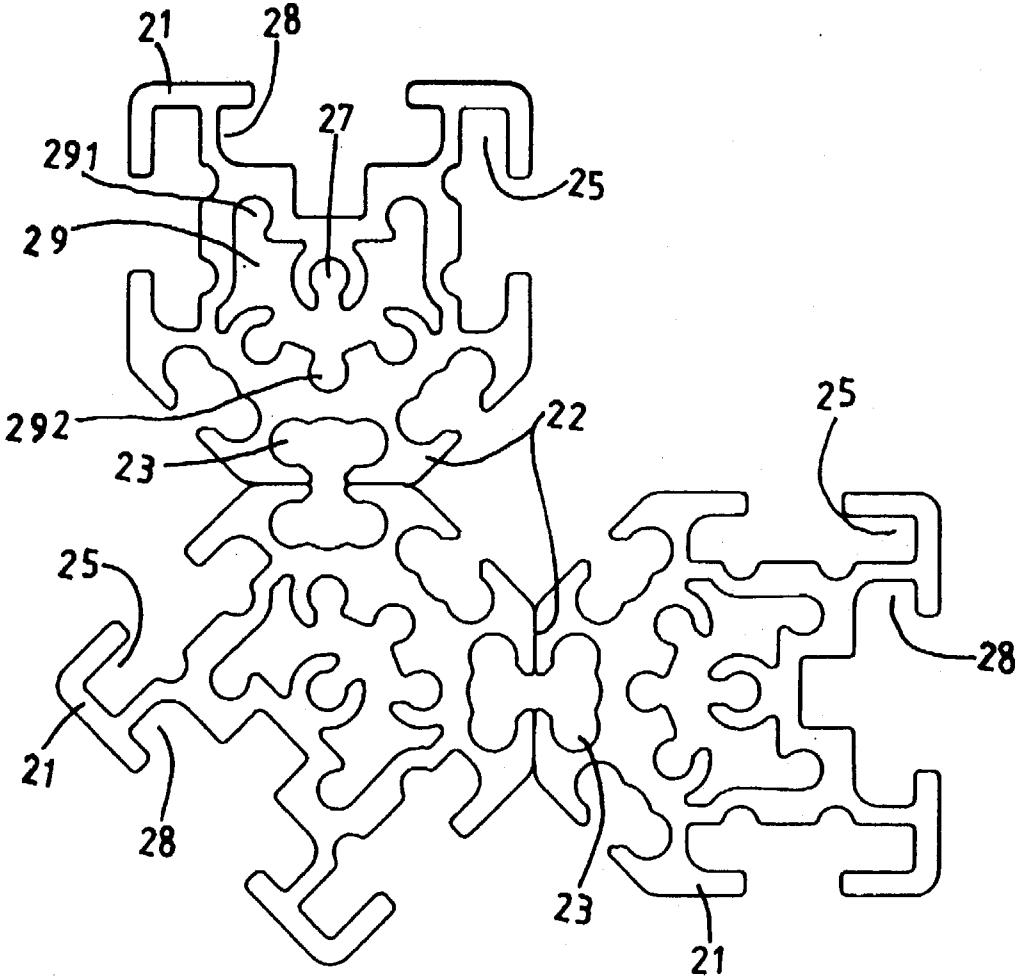

As shown in FIGS. 5 and 6, the screen combination comprises a number of accessories. The heads 511 of the screws 51 may be slidably engaged in the C-shaped channels 25 for engaging with the holes 562 of a bracket 56 and for engaging with the nuts 52 so as to secure the brackets 56 to the beams 21. The brackets 56 may be provided for supporting a table plate thereon which is secured to the brackets 56 by screws that threaded through the holes 561 of the brackets 56. An electric socket 57 may also be secured to the beam 21 by screws 51. A C-shaped bar 58 and a bar 581 may also be secured to the beam 21 for attaching casings to the beams 21. One or more coupler members 59 are secured to the beams 21 for attaching book shelves to the beams 21. Small brackets 591 may be provided for attaching small table to the brams 21. Reinforcing bars 53, 54, 55 are provided for reinforcing the coupling of the beams 21, 31.

Figure 16:
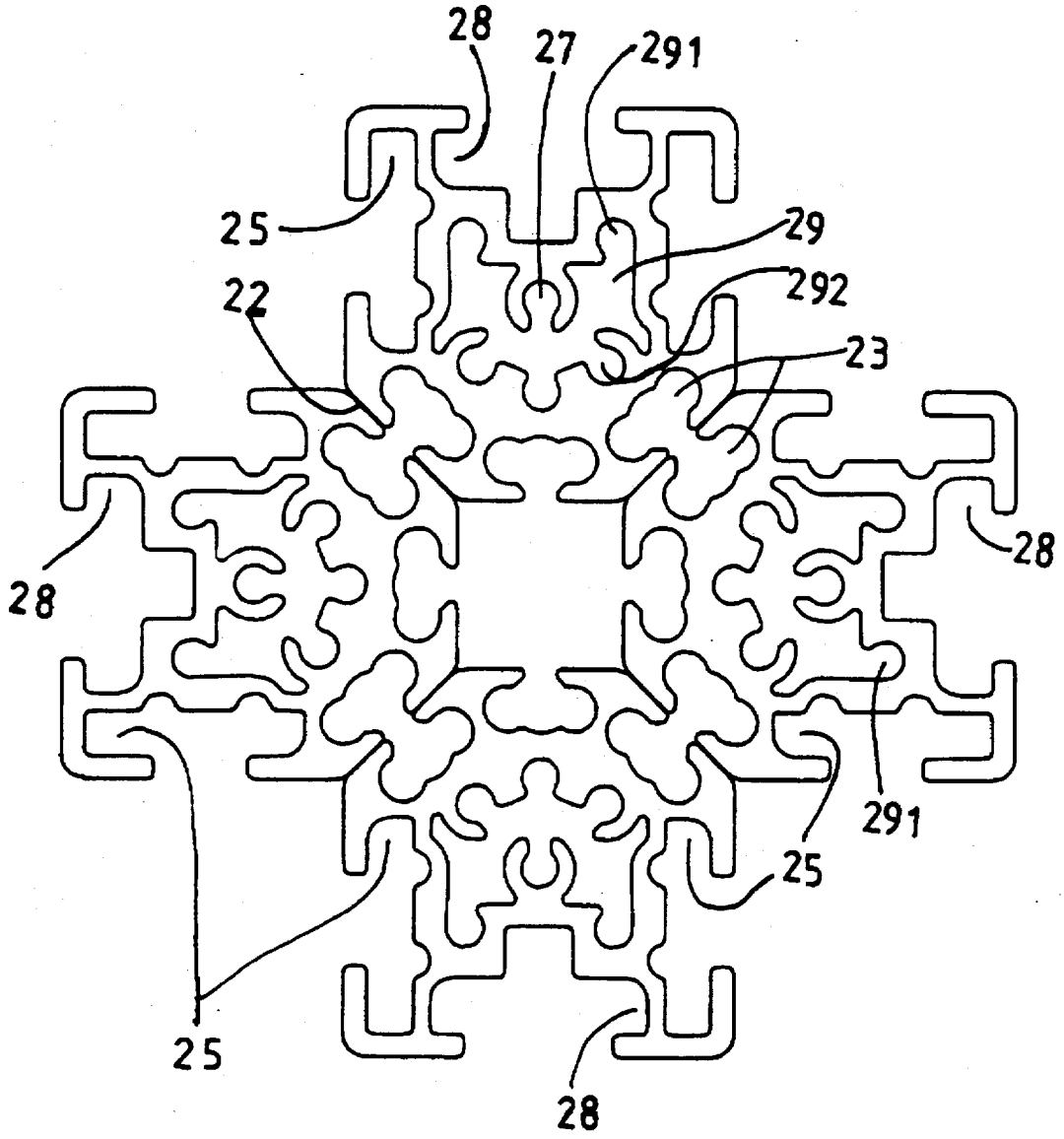

As shown in FIGS. 7–10, a number of tenons 10, 11 each includes one or more projections 101, 111 for engaging with the mortises 23 of the beams 21 so as to couple two or more beams 21 together. The tenons 10, 11 each includes one or more holes 102, 112 for engaging with screws 43 which are engaged with the screw holes 292 so as to secure the tenons 10, 11 to the beams 21. The tenon 11 includes a neck 113 for slidably engaging with the mortises 23. As shown in FIGS. 11–16, two or more beams 21 may be assembled together by the tenons 10, 11 and may be arranged to suitable angular position one relative to the others according to the users need. As shown in FIG. 16, four frames may be easily assembled together so as to form a cross shape by the tenons.

Accordingly, the screen combination in accordance with the present invention includes a number of panels that may be easily assembled and that may be easily disassembled and that may be assembled according to the users need.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A screen combination comprising:

at least two panels each including two side portions and an upper portion and a bottom portion;

at least two frames each including two side beams and an upper beam and a lower beam for engaging with said side portions and said upper portion and said bottom portion of one said panel respectively, said upper and said side beams each including three flat surfaces, said flat surfaces each including a mortise formed therein, said upper and said side beams each including two side portions each having a channel formed therein, said upper and said side beams each including a groove formed therein engaging with said upper portion and said side portions of one said panel respectively, a plurality of angles each including two plates secured to said upper and said lower beams and said side beams so as to couple said beams together, and a plurality of tenons engaged with said mortises so as to couple said frames together.

2. A screen combination according to claim 1 further comprising a plurality of screws each including a head slidably engaging with said channels so as to attach accessories to said beams.

* * * * *